73-151
8/16/77 OR 4,041,780 SR

United States Patent [19]
Angehrn

[11] 4,041,780
[45] Aug. 16, 1977

[54] METHOD AND APPARATUS FOR LOGGING EARTH BOREHOLES

[75] Inventor: Jorg August Angehrn, Houston, Tex.

[73] Assignee: Dresser Industries, Inc., Dallas, Tex.

[21] Appl. No.: 682,940

[22] Filed: May 3, 1976

[51] Int. Cl.[2] ..... E21B 47/00
[52] U.S. Cl. ..... 73/151
[58] Field of Search ..... 73/151, 152; 175/50; 340/18 NC, 18 LD

[56] References Cited

U.S. PATENT DOCUMENTS

| | | | |
|---|---|---|---|
| 2,898,088 | 8/1959 | Alder | 175/50 X |
| 3,149,683 | 9/1964 | Clements et al. | 175/50 |
| 3,223,184 | 12/1965 | Jones et al. | 175/50 X |
| 3,320,441 | 5/1967 | Pehoushek | 175/50 X |

*Primary Examiner*—Jerry W. Myracle
*Attorney, Agent, or Firm*—William E. Johnson, Jr.

[57] ABSTRACT

A self-contained, battery powered well logging instrument is pumped down the interior of a drill pipe string having a catcher sub at its lower end. When the logging instrument latches into the catcher sub, the pumped fluid circulation is blocked, after which increased pump pressure switches a valve assembly to recreate circulation and energize the logging instrument to the standby position. An accelerometer in the logging instrument detects the upward movement of the instrument and switches the circuitry from standby to the record mode. The output from a clock controlled by the downhole accelerometer is recorded along with the logging information and is synchronized with pipe footage measurements and with a similar such accelerometer and clock at the earth's surface which are responsive to the movement of the pipe string at the earth's surface. The recorded logging samples are thus related to true depth by correlating with the data simultaneously recorded at the earth's surface. As an alternative embodiment, the logging instrument is attached to the drill pipe prior to running the pipe into the borehole.

15 Claims, 7 Drawing Figures

METHOD AND APPARATUS FOR LOGGING EARTH BOREHOLES

BACKGROUND OF THE INVENTION

This invention relates generally to methods and apparatus for logging earth boreholes and specifically to methods and apparatus utilizing self-contained well logging instruments in earth boreholes.

It has become relatively common within the last few years to drill wells in the search for oil and gas and the like with a portion of the bore deviating from the usual vertical orientation thereof. The deviation or inclination may extend for a considerable distance at angles ranging to 70°, sometimes returning to the usual vertical orientation. In some instances, such boreholes may even extend past 90° from the vertical and actually be extending in the "up" direction for some distance.

It is also well known in the art of drilling such wells to attempt the logging of the formations surrounding such boreholes with logging instruments run into the well bore on a wireline and/or cable to perform various operations. Such tools usually depend upon the force of gravity to permit positioning of the well tools at the desired formation in the well bore.

Manifestly, the relatively horizontal angle of the deviated portion of the well bore will not permit the wireline-actuated tools to move into the lower portion of the well bore since the friction of the well tool in the deviated portion works against the force of gravity. Thus, it has become essential to provide some means of causing the well logging instrument to pass through the deviated portions of the well bore.

Another problem associated with such boreholes relates to the instability of some formations penetrated by the well bore, thus causing borehole diameter changes, some very abrupt. Ledges are formed and the logging instrument lodges against them.

Furthermore, although there have been attempts in the prior art to pump logging instruments down the borehole, such instruments have generally suffered from the problems associated with having a wireline attached to the instrument, or because of having no correlation between the well logging signals and the true depth in the borehole.

It is therefore the primary object of the present invention to provide a new and improved method and apparatus for logging earth boreholes;

It is also an object of the present invention to provide new and improved method and apparatus for logging deviated boreholes requiring no wireline from the earth's surface;

It is yet another object of the present invention to provide new and improved method and apparatus for logging earth boreholes and for correlating the logging data with the true depth in the borehole.

The objects of the invention are accomplished, generally, by apparatus positioned in the lower end of a string of pipe or tubing in an earth borehole and having means for recording logging data in the borehole in correlation with data simultaneously recorded at the earth's surface, and by methods relating thereto.

These and other objects, features and advantages of the present invention will be apparent from the following detailed description taken with reference to the figures of the accompanying drawing, wherein.

Figure 1:
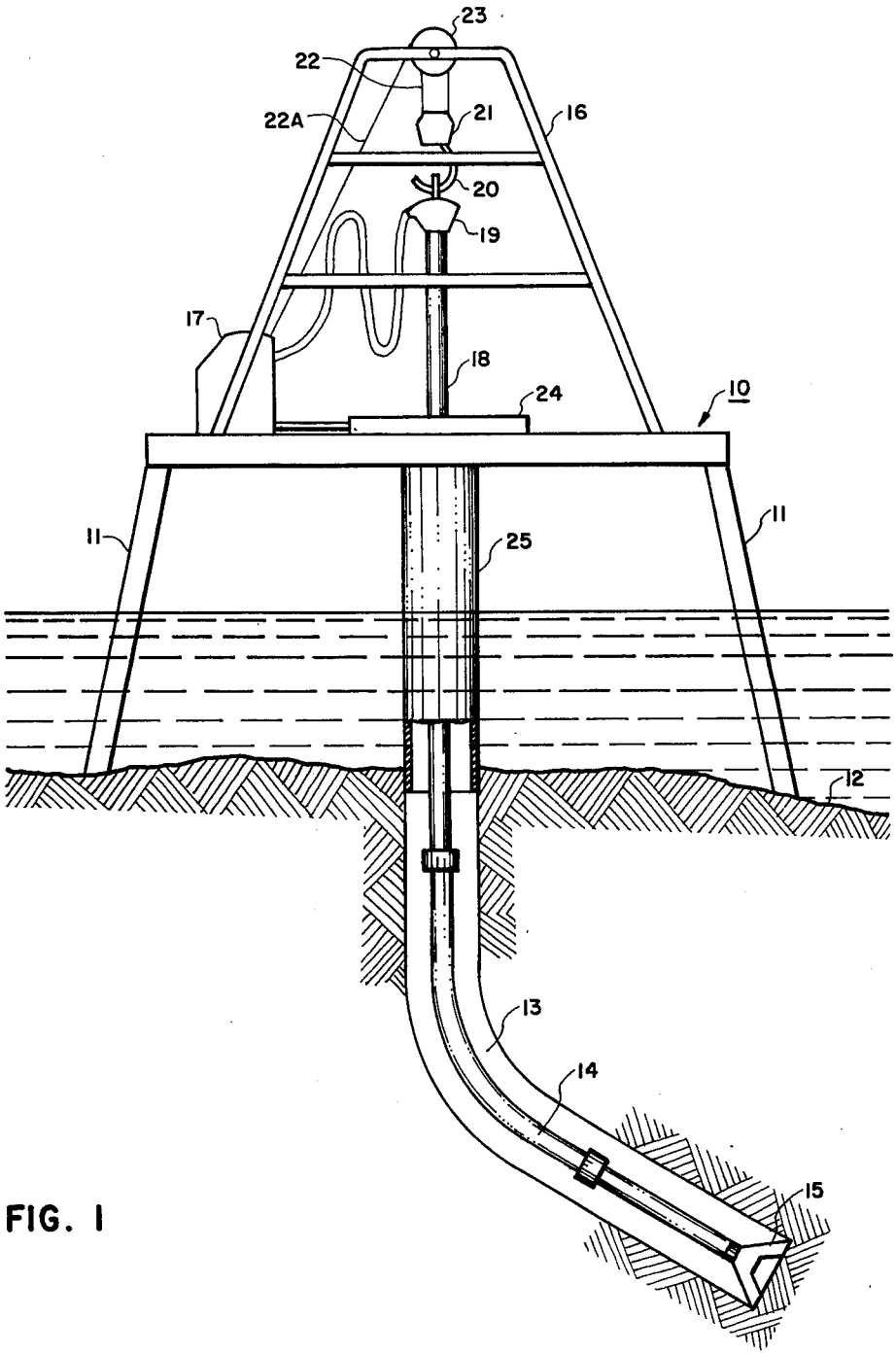
FIG. 1 is a schematic view illustrating the drilling of a deviated earth borehole from an offshore platform.

Referring now to the drawing in more detail, especially to FIG. 1, there is illustrated schematically a conventional system for drilling an earth borehole having a high degree of deviation from true vertical. As is well known in the art, it is common practice to drill such slanted wells from offshore platforms. A drilling platform 10 having a plurality of legs 11 anchored on the ocean floor 12 has an earth borehole 13 drilled therefrom. Within the borehole 13 is a pipe string 14, to the lower end of which is attached a drill bit 15. A surface casing 25 maintains the integrity of the borehole 13 as is well known in the art. A derrick 16 with its conventional drawworks 17 is mounted on the platform 10. The drill string 14 comprises a number of joined sections of pipe terminating at its upper end in a kelly 18, followed by a swivel 19, a hook 20 and a traveling block 21 suspended by a drilling line 22 from a crown block 23. The drawworks also drive a rotary table 24 which in turn transmits the drive to the kelly 18. One end of the line 22, namely the fast line **22*a*, is connected to the drawworks 17** which contains the motor or motors for manipulating the drill string. Although not illustrated, the other end of the drill line is secured to an anchor on the platform floor, that portion of the line extending to the anchor from the crown block being generally referred to as the dead line. Again not illustrated, such an anchor member normally would include a winding-on drum and can also, if desired, contain a dead line sensor for monitoring the weight on the bit, for example, as shown in U.S. Pat. No. 3,461,978 to F. Whittle, issued Aug. 19, 1969.

In the operation of the system according to FIG. 1, it is quite conventional in drilling wells from such offshore platforms to drill the initial portion of the well substantially along a vertical line from the platform and then to angle off in the further drilling of the well. Such wells after angling off will oftentimes be inclined at an angle of 60° to 70° from vertical. It is with these types of highly deviated wells that the problem presents itself as to providing a log of the formations surrounding the well bore.

Figure 2:
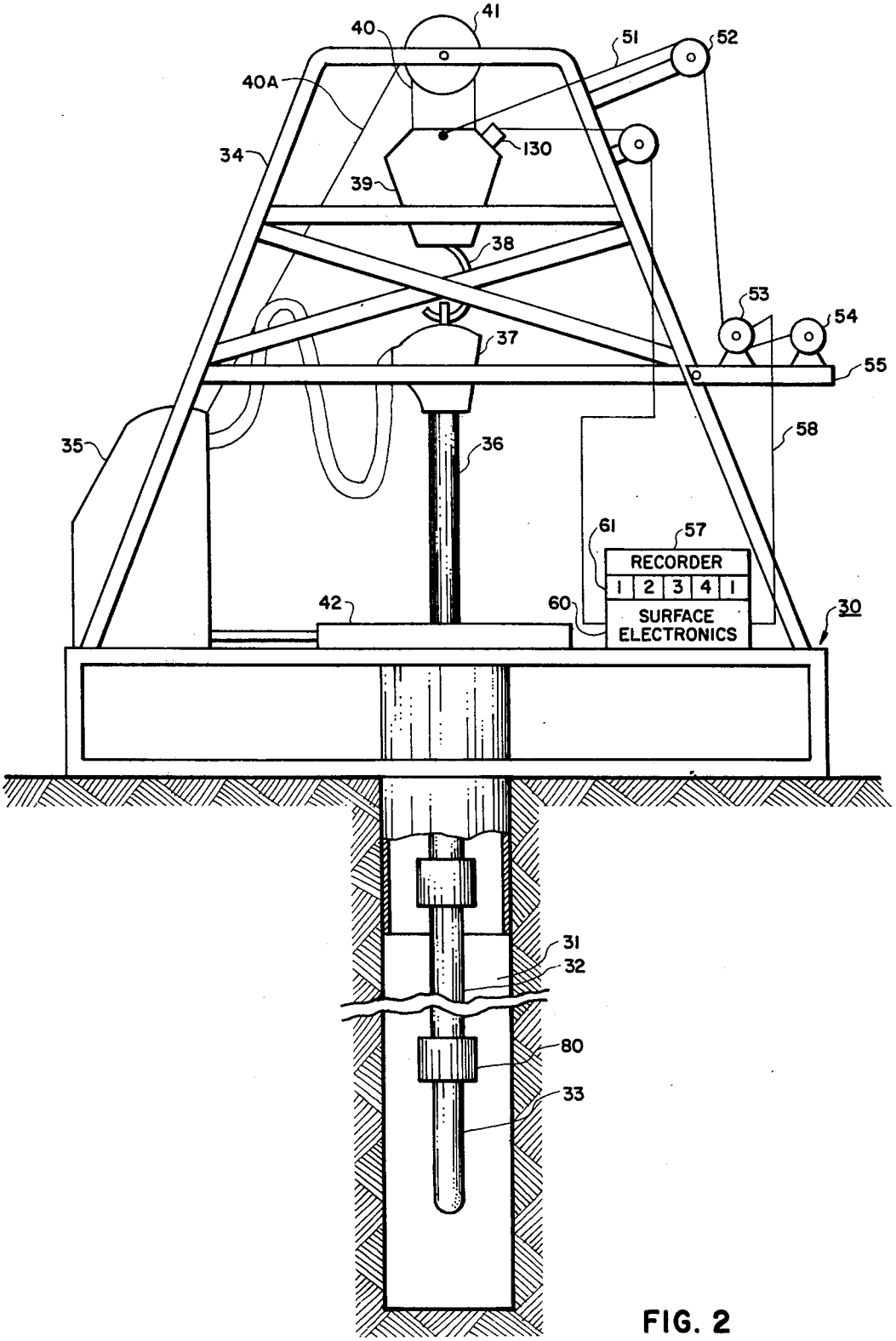
FIG. 2 is a schematic view illustrating an earth borehole drilled from an onshore rig wherein the well logging instrument has been pumped down the interior of the drill string in accordance with the present invention.

Referring now to FIG. 2, a drilling rig similar to that illustrated in FIG. 1, but which is mounted on the earth's surface, is illustrated for purposes of showing the well logging instrument attached to the drill pipe in accordance with the present invention. A drilling platform 30 is mounted on the earth's surface from which an earth borehole 31 has been drilled. The earth borehole 31 might or might not be slanted a substantial amount from vertical but is illustrated, for convenience, as being vertical. Within the borehole 31 is a pipe string 32, to the lower end of which is attached a logging instrument 33 which is illustrated in greater detail in FIG. 3 hereinafter. A derrick 34 with its conventional drawworks 35 is mounted on the platform 30. The drill string 32 comprises a number of joined sections of pipe terminating at its upper end in a kelly 36, followed by swivel 37, a hoo, 38 and a traveling block 39 suspended by a drilling line 40 from a crown block 41. One end of the line 40, namely the fast line **40*A*, is connected to the drawworks 35 which contain the motor or motors for manipulating the drill string. The drawworks 35 also drive a rotary table 42 which in turn transmits the drive to the kelly 36**.

Again not illustrated, and as discussed with respect to FIG. 1, the other end of the drilling line is normally attached to an anchor on the floor of the drilling platform 30.

Referring further to FIG. 2, there is illustrated a wireline 51 connected at one of its ends to the traveling block 39, passing over a wheel 52 mounted on the derrick 34. The wireline 51 then passes over a wheel 53 to a rewind drum 54, the wheel 53 being illustrated in more detail in FIG. 4. The wheel 53 and rewind drum 54 are each mounted on a support member 55 attached to the derrick 34, or some other suitable point. As is explained with respect to FIG. 4, the wheel 53 drives a pulse generator having a voltage output on conductor line 58 connected to the circuitry 60, bearing the legend "SURFACE ELECTRONICS". A visual depth monitor 61 and recorder 57 are mounted above the SURFACE ELECTRONICS circuitry 60. The SURFACE ELECTRONICS circuitry 60 generally comprises the circuits illustrated in FIG. 's 4 and 6. An accelerometer 130 is also connected to the traveling block 39 and has its output connected into the circuitry 60.

Figure 3:
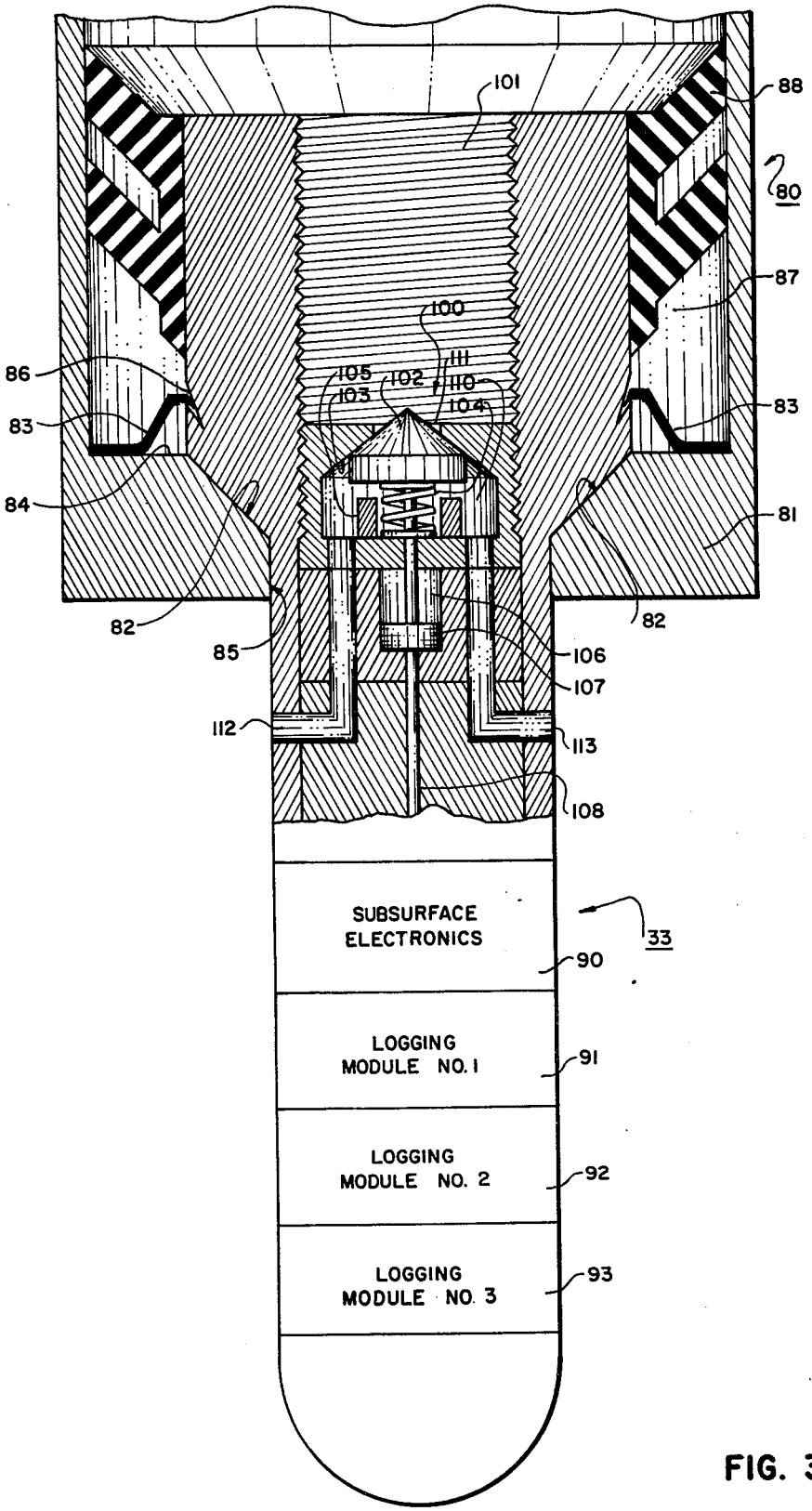
FIG. 3 is an enlarged schematic view, partly in cross section, illustrating the well logging instrument and lower catcher sub in the drill string in accordance with the present invention.

The operation of the system in accordance with FIG. 2 will be more readily understood taken in conjunction with the apparatus illustrated in FIG. 3. Suffice it to say at this point, that whenever it is desired to log the formation surrounding the borehole 31, the entire string of pipe 32 is pulled out of the borehole 31 and the drill bit, for example, as illustrated by the drill bit 15 in FIG. 1, is removed from the end of the drill string and then the drill string 32 is run back into the borehole 31. The logging instrument 33 is pumped down through the interior of the drill pipe 32 until it is caught by a special sub 80 at the lower end of the drill pipe string, again as illustrated in greater detail with respect to FIG. 3.

Figure 4:
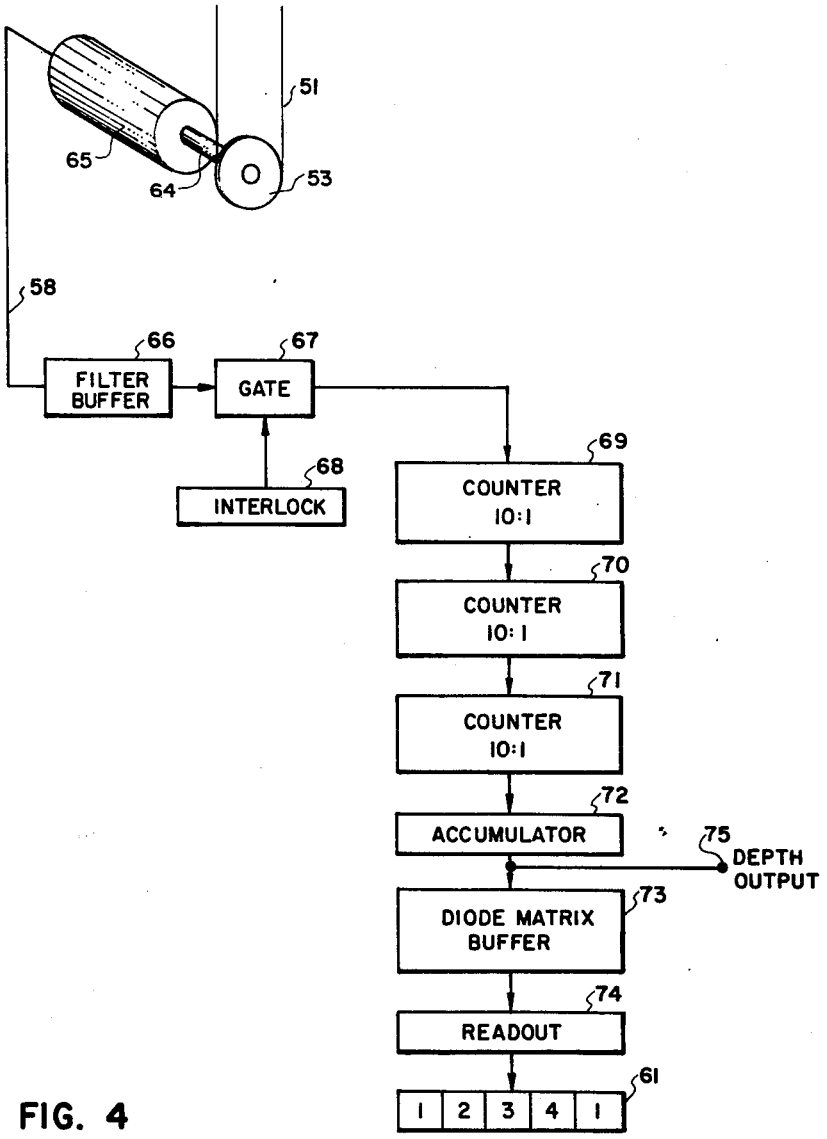
FIG. 4 is a schematic view, partly in block diagram, of a depth encoder used in accordance with the present invention.

Referring now to FIG. 4, there is illustrated the wheel 53, driven by the wireline 51, which in turn is adapted to drive the rotational encoder mechanism 65 which converts rotational movement (of the wheel 53) into electrical pulses. If desired, the encoder described in U.S. Pat. No. 3,426,303 to Guy O. Buckner, issued Feb. 4, 1969, and assigned to the assignee of the present invention, can be used for this purpose. Thus, as the wheel 53 turns, electrical pulses appear on conductor 58. By conventional gearing, the output of the encoder 65 produces 100 electrical pulses, each preferably having a square wave output, for each revolution of the shaft 64. The output of the apparatus 65 is coupled into a conventional filter and buffer section 66 and then into a gate circuit 67. Also coupled into the gate 67 is an interlock circuit 68, which may be, if desired, merely a manual switch which may be operated by the operator to close the gate 67 whenever the cable 51 reverses direction. Such an interlock is desirable to thus provide an electrical indication of travel only whenever the traveling block and kelly assembly is moving in the desired direction. If desired, however, the interlock circuitry 68 can be automatically responsive to the movement of the kelly in the desired direction and also act to close the gate 67 whenever the kelly is moving in that same direction, as, for example, through a one-way clutch. If desired, interlock circuit 68 can be made automatically responsive to a given speed of the drill bit, the weight on the bit or mud pressure, to name but a few examples.

It should be appreciated that when the borehole is being drilled, i.e., the drill bit is still attached to the drill pipe, and the drill pipe and drill bit are traveling in a downward direction, it is preferable to have gate 67 closed so an accurate determination can be made of the depth of the drill bit. In a similar manner, whenever the drill bit has been removed and replaced by the well logging instrument 33 as illustrated in FIG. 2, it is also desirable to have the gate 67 activated so that the depth of the logging instrument can be ascertained. In such cases, the interlock 68 and gate 67 can be bypassed so that the output of the filter buffer circuit 66 continuously feeds into the counter 69. The output of the gate 67 is connected to the input of the tandem counters 69, 70 and 71, each of these counters preferably having a 10:1 ratio. Thus, for each of the counters having such a ratio, for each ten pulses into the particular counter, only one pulse is seen on its output. The output of the counter 71 is coupled into a conventional accumulator circuit 72 which drives a diode matrix and buffer circuit 73 which in turn drives the readout section 74. The readout section 74 drives a visual depth monitor 61. The output of the accumulator circuit 72 has an additional output 75, bearing the legend "DEPTH OUTPUT".

In the operation of the circuit of FIG. 4, by proper gearing (not illustrated), the shaft 64 makes 20 revolutions for each two feet of travel of the cable 51. For each foot of travel, the shaft 64 makes ten revolutions. Since the device 65 creates 100 pulses per revolution, the output of the device 65 is thus seen to be 1000 pulses per one foot of travel of the cable 51. Since the series of counters 69, 70 and 71 create a single output pulse for each 1000 pulses in from the gate 67, it should be appreciated that the output of counter 71 is one pulse per each foot of travel of cable 51. The output of the accumulator 72, as represented by five decades of BCD readout having 21 lines, is then coupled into the diode matrix and buffer 73 to drive the readout circuit 74 and visual monitor 61. For reasons as set forth herinafter, the DEPTH OUTPUT terminal 75 is connected to the circuitry of FIG. 6 for purposes of ascertaining the depth of the borehole logging instrument 33 as illustrated in FIG. 2.

Referring now to FIG. 3, the logging instrument 33 and catcher sub 80, illustrated generally in FIG. 2, are shown in greater detail. Although not illustrated, the upper portion of the catcher sub 80 is adapted to be threaded directly onto the lower end of the drill pipe 32. The catcher sub 80 is substantially cylindrical in shape, having its lower end closed in by the end-body portion 81 of sub 80 except for a funnel-like opening in its center, the funnel having an orifice 85 of slightly larger diameter than the cylindrically shaped lower portion of the logging instrument 33. The funnel, formed in the body 81, has downwardly and inwardly tapered surfaces 82 adapted to provide a metal-to-metal seal between such tapered surfaces and the similarly angled surfaces on portions of the logging instrument 33. A plurality of spring members 83 are attached to the planar surface 84 of the end-body 81 of the interior of the sub 80 for purposes of securing the borehole logging instrument 33 as it is being sealed to the tapered surfaces 82.

The well logging instrument 33, having a subsurface electronic section 90 and three conventional well logging modules 91, 92 and 93, bearing the legends, respectively, "LOGGING MODULE NO. 1", "LOGGING MODULE NO. 2", and "LOGGING MODULE NO. 3", has a lower end which is cylindrical in shape and is adapted to pass through the center orifice 85 of the catcher sub 80. Theupper portion of the logging instrument 33 has a larger diameter, tapered to match the tapered surfaces 82 of the catcher sub which are tapered inwardly and downwardly toward the orifice 85. The portion of the logging instrument 33 above the tapered surfaces is substantially cylindrical in shape and has a continuous groove 86 around a portion of its periphery adapted to be engaged by the spring members 83 for latching the logging instrument in place during the time that it is being sealed against the tapered surfaces 82. In addition, a rubber sealing element 87 is formed in an encircling manner around the upper periphery of the well logging instrument 33 to enable the instrument to be pumped down through the drill string. The sealing element 87 has a plurality of flexible fingers 88 which enables the device to be pumped through portions of the drill pipe and collars having internal diameters of varying dimensions.

A spring-loaded valve assembly 100 is threadedly engaged with a central bore 101 of the upper portion of the logging instrument 33. The valve assembly includes a valve 102, a valve seat 103, a spring 104 and a spring housing 105. The valve 102 is located within a central chamber 110 having an upper opening 111 and a pair of lower channels 112 and 113. A central shaft 106 is connected to the lower side of the valve 102 through the interior of the spring 104 and is adapted to move as the valve 102 moves. The lower end of the shaft 106 is connected to an electrical microswitch 107, located within a cavity beneath the valve assembly, which is sealingly isolated from the flow of pumped fluids as hereinafter described. A conduit 108 connected to the microswitch 107 allows a pair of electrical wires to travel from the microswitch 107 to the subsurface electronics section 90 as hereinafter described with respect to FIG. 5.

In the operation of the well logging instrument 33 and catcher sub 80 as hereinbefore described, the drill string having the catcher sub 80 installed on the lower end of the drill pipe 32, is first lowered into the borehole 31 of FIG. 2. The string of drill pipe is made up and lower end of the drill pipe and the catcher sub 80 are located at some desired or predetermined depth. The logging instrument 33 is then inserted into the interior of the drill string at the earth's surface and is pumped down using the conventional mud pumping equipment used as a normal circulation means in drilling an earth borehole. While the instrument is being pumped down inside the interior of the drill pipe, the valve 102 is maintained closed by the spring 104. It should be appreciated that once the logging instrument is sealed against the catcher sub 80, the strength of the spring 104 must relate to the hydrostatic pressure of the column of drilling mud or other circulation fluid which is being used to pump down the instrument. When the instrument 33 finally arrives at the catcher sub 80, the lower end of the instrument 33 will pass through the center orifice 85 and the tapered surfaces of the logging instrument 33 will seal against the matching or mated tapered surfaces 82 of the catcher sub 80. Although the matching tapered surfaces can provide a metal-to-metal seal, those skilled in the art will recognize that additional sealing means, such as rubber, can be used to insure the integrity of the seal. In addition, as the instrument is being sealed against the tapered surfaces 82, the spring members 83 will snap in place into the groove 86 around the periphery of the logging instrument 33 to secure the instrument in place.

At this point in time, the spring 104 acts against the hydrostatic pressure of the column of drilling mud and maintains the valve 102 closed against the valve seat 103. By increasing the pumping pressure of the drilling mud, the spring 104 is overcome, the valve 102 moves down and the drilling mud passes through the center orifice 111 to the channels 112 and 113 and thus into the borehole. By this means, circulation is re-established. At the same time, the shaft 106 moves within the microswitch 107 to complete the electrical circuit as explained hereinafter with respect to FIG. 5.

Figure 5:
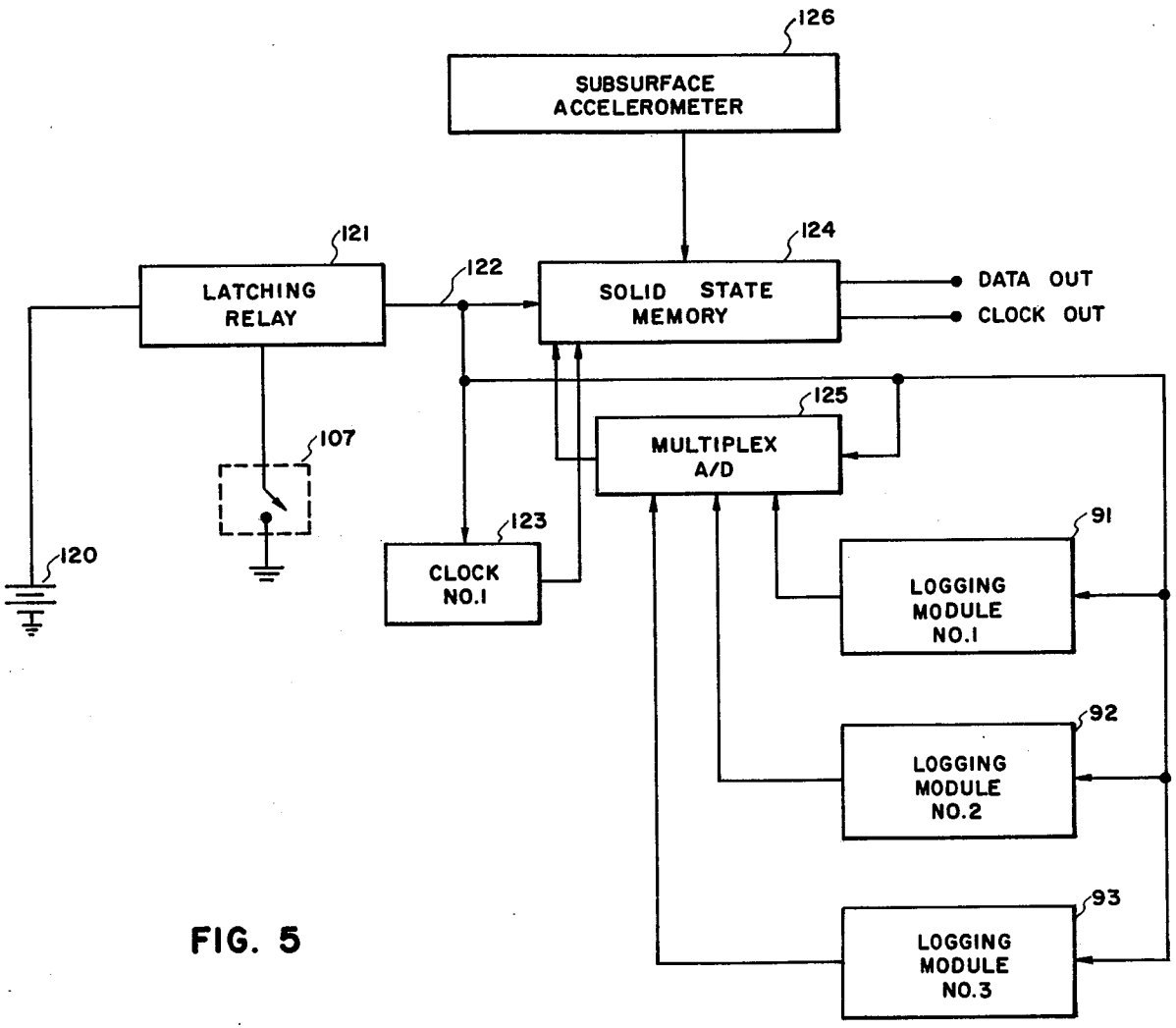
FIG. 5 is a block diagram of the electrical circuitry utilized in the well logging instrument in accordance with the present invention.

Referring now to FIG. 5, the electrical circuitry utilized within the well logging instrument 33 of FIG. 3 is shown in block diagram. It should be appreciated that since the well logging instrument 33 is self-contained, i.e., does not have an electrical cable connecting it with the earth's surface, the entire electrical supply must come from the well logging instrument itself. This is provided by a battery 120 which has its positive side connected through a latching relay 121. The latching relay is activated by the operation of the microswitch 107 illustrated in FIG. 3. Once activated by the microswitch 107, the relay 121 remains activated until manually deactivated at the earth's surface. Thus, as the microswitch 107 is activated by movement of the valve 102 in response to increased pump pressure, the latching relay 121 is activated and the positive side of the voltage 120 is thus seen on the conductor 122. The voltage appearing on conductor 122 is coupled into a clock 123, bearing the legend "CLOCK NO. 1", into a solid state memory circuit 124, into the LOGGING MODULES NO. 1, NO. 2 and NO. 3, and into a conventional multiplex analog-to-digital converter 125. The LOGGING MODULES NO. 1, NO. 2 and NO. 3 have their outputs connected into inputs of the multiplex analog-to-digital converter 125, whose output in turn is connected into a solid state memory circuit 124. The output of the clock 123 is also connected into an input of the solid state memory circuit 124. A subsurface accelerometer 126 is also located within the borehole logging instrument 33 and generates a signal which is connected to the solid state memory circuit 124.

In operation, all of the circuity of the logging instrument 33 is maintained in the de-energized position while the instrument is being pumped down inside the drill pipe string. Whenever the instrument is sealed at the lower end of the catcher sub 80, the microswitch 107 is activated and the voltage from the battery 120 is connected into the input of the solid state memory circuit 124. This voltage places the memory circuit in the "STANDBY" mode. As the drill pipe is then removed from the hole, that is, the drill pipe starts up the hole pulling the logging instrument with it, the subsurface accelerometer 126 generates a signal which then causes the solid state memory circuit to switch from STANDBY to the "ON" position. Thus, the multiplexed and digitized signals from the logging modules are coupled into the solid state memory circuit only in response to the movement of the drill pipe. Simultaneously, the output pulses from the clock 123 are copled into the solid state memory circuit 124. As is conventional in the pulling of drill pipe, a plurality of drill pipe sections, usually three, are pulled out of the hole and swung out of the way. When this happens, the accelerometer 126 is no longer generating a signal and the solid state memory circuit converts back from the ON state to the STANDBY state. Thus, it should be appreciated that the only time that logging signals and the clock signals from the clock 123 are going into the solid state memory is whenever the pipe is moving. This sequence is repeated each time the pipe starts moving again, for example, every time three more sections of the drill pipe are pulled out of the hole.

Figure 6:
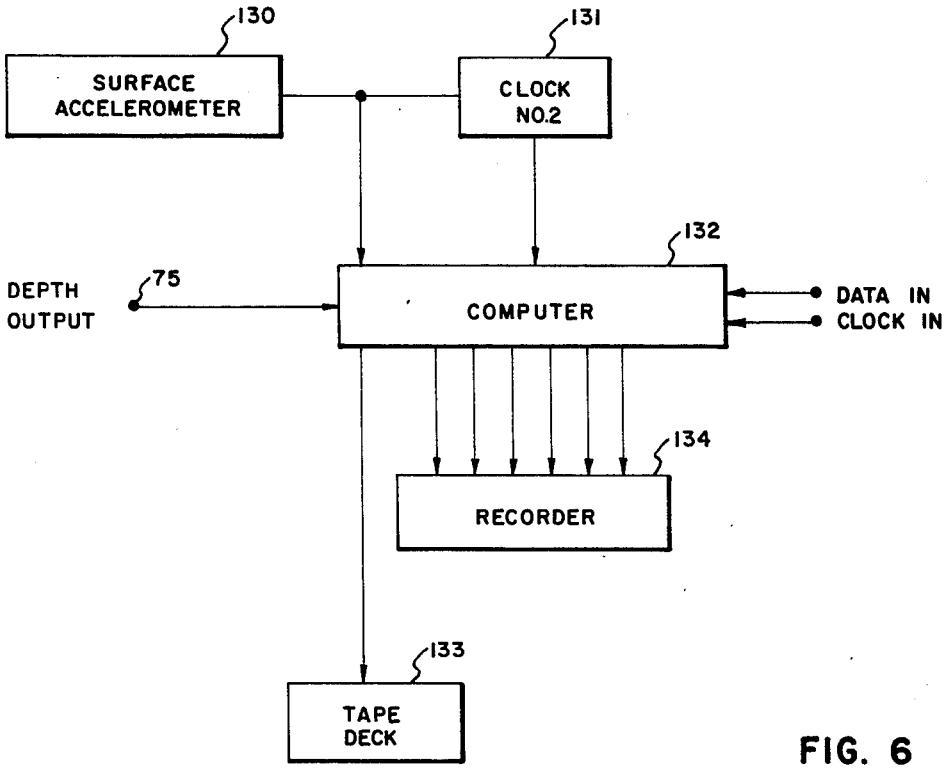
FIG. 6 is a block diagram of the surface electronics in accordance with the present invention.

Referring now to FIG. 6, there is illustrated in greater detail the surface electronics circuitry 60 illustrated generally in FIG. 2. The circuitry includes a surface accelerometer 130 which is mounted on the traveling block 39 of FIG. 2. The surface accelerometer has its output connected to a clock 131, bearing the legend "CLOCK NO. 2" which has a frequency output which is either identical to that of CLOCK NO. 1 of the subsurface instrument, or has some known relationship thereto. The output of the surface accelerometer 130, as well as the output of the clock 131, is connected to a computer 132, for example, a mini-computer stationed preferably at the well location. The depth output 75 is also connected to one of the inputs of the computer 132. The output of the computer is coupled into a tape deck 133 and also has six outputs connected into a recorder 134 having visual printouts such as the six recordings illustrated in FIG. 7.

In the operation of the circuitry in FIG. 6, after the well logging instrument is finally retrieved from the borehole, the data-out and clock-out outputs of the solid state memory circuit 124 are connected into the data-in and clock-in inputs of the computer 132.

Figure 7:
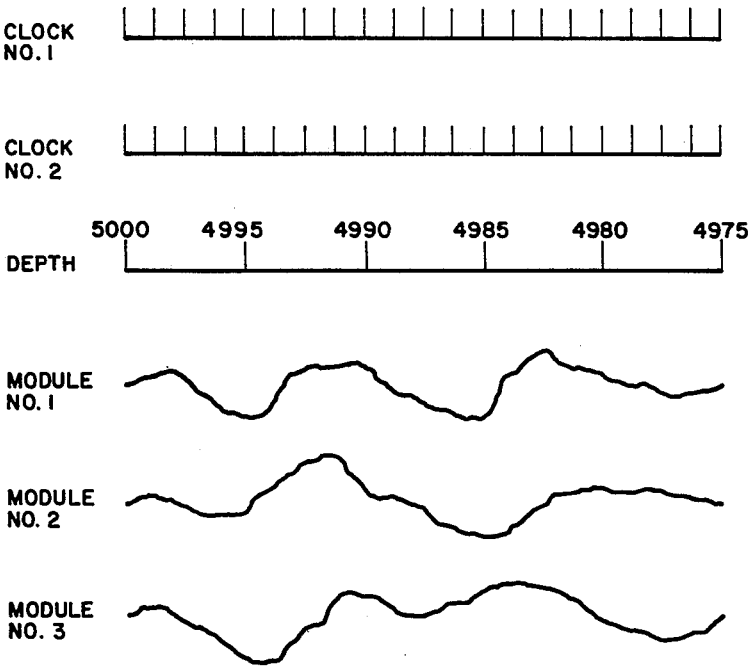
FIG. 7 schematically illustrates representative waveforms recorded at the earth's surface in accordance with the present invention.

In observing the overall operation of the system, taken in conjunction with the characteristic displays illustrated in FIG. 7, it should be appreciated that after the borehole instrument 33 has been pumped down the pipe string and has activated the microswitch 107 to place the solid state memory circuitry in STANDBY, the system is ready to begin logging the borehole. As soon as the drill pipe starts being pulled out of the well, both the surface accelerometer and subsurface accelerometer produce signals because of the movement of the pipe. This in turn causes the CLOCK NO. 1 and CLOCK NO. 2, respectively, to generate clock signals, preferably of the same frequency. Coincident with the generation of signals by the two clocks, depth signals are also obtained and recorded. In addition, the logging signals in the three modules are recorded by the solid state memory circuit. At the end of the logging run, after the solid state memory circuit is retrieved from the borehole and its outputs coupled into the computer 132, all that is required to synchronize the logging data with the depth data is to synchronize the beginning of the signals from CLOCK NO. 1 with the beginning of the signals from CLOCK NO. 2. In this manner, the logging data can be correlated with the depth data to indicate characteristics of formations surrounding the borehole at a given depth.

The preferred embodiment of the present invention contemplates the well logging instrument being pumped down the interior of the drill pipe after the drill pipe is in place in the borehole and then being seated in the catcher sub at the bottom of the drill pipe. However, the invention also contemplates the logging instrument being attached to the bottom end of the drill string prior to its being run into the hole. With such a system, by using an accelerometer that is sensitive only to upward motion of the drill pipe, the movement of the logging instrument and drill pipe while going into the hole will not cause the recording system to be operative. However, when the logging instrument is at the desired depth, the drill pipe can then be pulled out of the ground and the formations logged in the same manner as was discussed heretofore with respect to the pumped down instrument.

Thus it should be appreciated that the preferred embodiment of methods and apparatus for logging a well using self-contained logging instruments has been described herein. Obvious modifications to the preferred embodiment will be apparent to those skilled in the art from a reading of the foregoing detailed specification and drawing. For example, instead of using drill pipe to pump the instrument down to the bottom of the well bore, tubing can be used such as is used in the production of oil and gas wells. Furthermore, additional techniques can be used to conserve the memory capacity in the well logging instrument. For example, the data can be compressed and only the difference between subsequent samples stored. It should be appreciated that although solid state memory is preferred because of the reduction of power consumption and also the thermal isolation from the borehole temperatures which can be achieved, other memory devices such as tape recorders can be used in the downhole instrument if power is available. Likewise, although the preferred embodiment contemplates that the true depth measurement, which of course can be corrected for pipe stretch using conventional methods, is taken from the accumulator 72, it can also be taken elsewhere in the circuit of FIG. 4, depending upon the footage pulses desired for given depth increments.

The embodiments of the invention in which an exclusive property or privilege is claimed are defined as follows:

1. A method of logging the formations surrounding an earth borehole, comprising:

attaching a well logging instrument to the lower end of a string of pipe in said borehole;

moving said pipe through said borehole;

activating said well logging instrument in response to the upward movement of said pipe;

recording logging data in said instrument functionally related to said instrument being activated;

recording at the earth's surface indications of depth in the borehole in response to the movement of said pipe;

removing said logging instrument from said borehole; and synchronizing said recorded logging data with said recorded depth indications.

2. A method of logging the formations surrounding an earth borehole, comprising:

moving a well logging instrument attached to the lower end of a string of tubular goods through an earth borehole;

generating and recording electrical clock pulses in said instrument functionally related to the movement of said instrument through said borehole;

recording logging data in said instrument functionally related to the movement of said instrument through said borehole;

generating and recording electrical clock pulses at the earth's surface functionally related to the movement of said tubular goods through said borehole;

recording indications at the earth's surface of the depth of said logging instrument in said borehole;

removing said logging instrument from said borehole; and synchronizing said recorded logging clock pulses, said recorded earth's surface clock pulses, said recorded depth indications and said recorded logging data to thereby correlate said logging data with the depth of the logging instrument in the borehole.

3. A method of logging the formations surrounding an earth borehole, comprising:

moving a well logging instrument attached to the lower end of a string of tubular goods through an earth borehole;

generating and storing first sync signals in said instrument in response to the movement of said instrument through said borehole;

storing logging data in said instrument, said stored data having a known time relationship to said first stored sync signals;

generating and storing second sync signals at the earth's surface in response to the movement of said string of tubular goods through said borehole;

measuring and storing indications at the earth's surface of the depth of said logging instrument in said borehole, said stored depth indications having a known time relationship to said second stored sync signals;

removing said logging instrument from said borehole; and synchronizing said first and second sync signals, said depth indications and said logging data to thereby correlate said logging data with the depth of the logging instrument in the borehole.

4. A method of logging the formations surrounding an earth borehole, comprising:

running a string of drill pipe into a previously drilled earth borehole;

pumping a well logging instrument through the interior of said pipe until said instrument is latched in place at the lower end of said pipe;

moving said instrument through said borehole by moving said string of drill pipe;

recording logging data in said instrument functionally related to the movement of said instrument through said borehole;

recording indications at the earth's surface of the depth of said logging instrument in said borehole;

removing said logging instrument from said borehole; and synchronizing said logging data with said depth indications.

5. A method of logging the formations surrounding an earth borehole, comprising:

running a string of drill pipe into a previously drilled earth borehole;

pumping a well logging instrument through the interior of said pipe until said instrument is sealingly latched in place at the lower end of said pipe;

moving said instrument through said borehole by moving said string of drill pipe;

recording logging data in said instrument functionally related to the movement of said instrument through said borehole;

recording indications at the earth's surface of the depth of said logging instrument in said borehole;

removing said logging instrument from said borehole; and synchronizing said logging data with said depth indications.

6. The method according to claim 5, including in addition thereto, the steps of increasing the pump pressure to re-establish fluid circulation through said drill pipe after said instrument is sealingly latched in place at the lower end of said pipe.

7. In a method of logging the formations surrounding an earth borehole wherein a self-contained well logging instrument is pumped down the interior of a string of tubular goods in said earth borehole, the improvement comprising the steps of:

sealingly latching said instrument in the lower part of said string of tubular goods; and increasing the pump pressure to activate at least a portion of the electrical circuitry in said instrument.

8. In a method of logging the formations surrounding an earth borehole wherein a self-contained well logging instrument is pumped down the interior of a string of tubular goods in said earth borehole, the improvement comprising the steps of:

sealingly latching said instrument in the lower part of said string of tubular goods; and increasing the pump pressure to re-establish circulation of fluid though said string of tubular goods and to activate at least a portion of the electrical circuitry in said instrument.

9. Apparatus for logging an earth borehole, comprising:

a string of drill pipe located within an earth borehole;

a well logging instrument adapted to be pumped through said string of drill pipe, said instrument having electrical circuitry;

means attached to the lower end of said string of pipe for catching said instrument after said instrument has partially passed through said means and into the borehole; and means to activate at least a portion of the electrical circuitry of said instrument after said instrument has been caught at the lower end of said string of pipe, said activation means comprising a spring-loaded valve assembly within said instrument responsive to a combination of the hydrostatic pressure of the pumped fluid within the drill pipe and the pump pressure itself.

10. The apparatus according to claim 9, wherein said activation means also comprises an accelerometer within said instrument.

11. Apparatus for logging an earth borehole, comprising:

a string of goods located within an earth borehole;

means for pumping fluid into the interior of said tubular goods; and a logging instrument attached to the lower end of said string of tubular goods, said instrument having electrical circuitry therein, said instrument having fluid-pressure responsive means therein for activating at least a portion of said electrical circuitry, said logging instrument also including an accelerometer for activating at least a portion of said electrical circuitry.

12. A well logging apparatus adapted to be pumped down through a string of tubular goods located within an earth borehole, comprising:

an elongated body member having at least one logging module and electrical circuitry therein, said body member also including an accelerometer for activating at least a portion of said electrical circuitry; and pressure-responsive means within said body member for activating at least a portion of said electrical circuitry.

13. A well logging apparatus adapted to be pumped down through a string of tubular goods located within an earth borehole, wherein said string of tubular goods has sealing means attached to its lower end, comprising:

an elongated body member having at least one logging module and electrical circuitry therein, said body member also including an accelerometer for activating at least a portion of said electrical circuitry;

instrument seal means carried by said body member and adapted to seal with said sealing means attached to the lower end of said string of tubular goods; and pressure-responsive means within said body member for activating at least a portion of said electrical circuitry.

14. The apparatus according to claim 13, wherein said pressure responsive means also includes at least one fluid channel adapted to re-establish fluid circulation after said seal means has sealed with said sealing means.

15. Apparatus for logging an earth borehole, comprising:

a string of tubular goods located within an earth borehole;

a borehole logging instrument attached to the lower end of said string of tubular goods;

means for moving said well logging instrument attached to the lower end of said string of tubular goods through said earth borehole;

means for generating and storing first sync signals in said instrument in response to the movement of said instrument through said borehole;

means for storing logging data in said instrument, said stored data having a known time relationship to said first stored sync signals;

means for generating and storing second sync signals at the earth's surface in response to the movement of said string of tubular goods through said borehole;

means for measuring and storing indications at the earth's surface of the depth of said logging instrument in said borehole, said stored depth indications having a known time relationship to said second stored sync signals;

means for removing said logging instrument from said borehole; and means for synchronizing said first and second sync signals, said depth indications and said logging data to thereby correlate said logging data with the depth of the logging instrument in the borehole.

* * * * *

UNITED STATES PATENT OFFICE

CERTIFICATE OF CORRECTION

Patent No. 4,041,780 Dated August 16, 1977

Inventor(s) Jorg August Angehrn

It is certified that error appears in the above-identified patent and that said Letters Patent are hereby corrected as shown below:

Claim 11, line 3 (column 10, line 58), after "of" insert --tubular--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*